US006101345A

United States Patent [19]

Van Goethem et al.

[11] Patent Number: 6,101,345

[45] **Date of Patent: *Aug. 8, 2000**

[54] METHOD FOR GLOSS CONTROL IN AN ELECTROGRAPHIC APPARATUS

[75] Inventors: Luc Van Goethem, Sint-Gillis-Waas; Serge Tavernier, Lint; Marc De Niel, Hove, all of Belgium

[73] Assignee: Agfa-Gevaert, Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 09/041,405

[22] Filed: Mar. 12, 1998

[30] Foreign Application Priority Data

Mar. 14, 1997 [EP] European Pat. Off. ..... 97200782

[51] Int. Cl.[7] ..... G03G 15/20

[52] U.S. Cl. ..... 399/69; 399/328; 399/341

[58] Field of Search ..... 399/67, 68, 69, 399/320, 328, 341, 342

[56] References Cited

U.S. PATENT DOCUMENTS

| | | | |
|---|---|---|---|
| 4,828,950 | 5/1989 | Crandall | 430/45 |
| 5,019,869 | 5/1991 | Patton | 399/320 |
| 5,162,860 | 11/1992 | Nami et al. . | |
| 5,164,782 | 11/1992 | Nagayama et al. | 399/320 |
| 5,170,215 | 12/1992 | Pfeuffer . | |
| 5,256,507 | 10/1993 | Aslam et al. | 430/42 |
| 5,296,904 | 3/1994 | Jackson | 399/328 |
| 5,300,995 | 4/1994 | Ohgita et al. . | |
| 5,321,481 | 6/1994 | Mathers . | |
| 5,379,098 | 1/1995 | Bennett et al. . | |
| 5,436,711 | 7/1995 | Hauser | 399/328 |
| 5,481,346 | 1/1996 | Ohzeki et al. . | |
| 5,493,378 | 2/1996 | Jamzadeh et al. . | |
| 5,504,567 | 4/1996 | Satoh et al. . | |
| 5,666,592 | 9/1997 | Aslam et al. | 399/67 |
| 5,678,133 | 10/1997 | Siegel | 399/67 |

FOREIGN PATENT DOCUMENTS

| | | |
|---|---|---|
| 0488412 | 6/1992 | European Pat. Off. . |
| 0720071 | 7/1996 | European Pat. Off. . |
| 0756161 | 1/1997 | European Pat. Off. . |
| 63-13088 | 1/1988 | Japan . |
| 6202520 | 7/1994 | Japan . |

OTHER PUBLICATIONS

"Preferred Gloss Levels for Color Images" from Electronic Imaging (vol. 5, No. 2), the newsletter of Electronic Imaging Working Group.

"Gloss Preferences for Color Xerographic Prints" by Swanton et al.; Journal of Imaging Science and Technology, vol. 40, No. 2, Mar./Apr. 1996; pp. 158–163.

*Primary Examiner*—Sandra Brase
*Attorney, Agent, or Firm*—Baker Botts L.L.P.

[57] ABSTRACT

A method for achieving a pre-selected gloss in an electrographic image printing system, by choosing the appropriate combination of fusing speed and fusing temperature.

As a result of the above, the homogeneity in gloss and color of one image and the homogeneity of different images, compared to each other, can be improved significantly.

30 Claims, 5 Drawing Sheets

METHOD FOR GLOSS CONTROL IN AN ELECTROGRAPHIC APPARATUS

FIELD OF THE INVENTION

The present invention relates to a method and apparatus for gloss control in the field of electrographic printing or copying systems. Electrographic printing or copying systems include electrostatic printing making use of a photosensitive member (electrophotography) and direct electrostatic printing.

BACKGROUND OF THE INVENTION

In an electrophotographic copier, an original image is exposed to light. The reflected light is irradiating a photosensitive drum or belt to form an electrostatic latent image thereon.

In an electrophotographic printing machine, a photoconductive medium is image-wise exposed by a LED, LED-array or scanning laser for forming an electrostatic latent image.

Toner is deposited on the latent image, wherein a toner image is formed on the drum or belt. This image is transferred onto a receiving sheet or web by a transfer unit and is fixed onto the receiving medium by a fixing or fusing unit.

Direct Electrostatic Printing is performed directly on a substrate by means of electronically addressable printheads. In Direct Electrostatic Printing the toner or developing material is deposited directly in an image-wise way on a substrate. The substrate can be an intermediate but it is preferentially the final receptor after a final fusing step.

In a fusing method utilizing thermal energy, a toner image formed on the receiving medium is melted by heating so as to adhere to the sheet. For this purpose the toner image is generally pressed by a roller heated-up to the temperature at which the toner material becomes adhesive.

In the roller fixing or fusing unit, a heater provided inside a roller is switched on/off under control of the temperature control system of the roller by means of a temperature detecting element provided near the surface of the roller.

A fixing or fusing roller is usually composed of a cylindrical metallic core preferably of aluminium, coated with silicone rubber or fluoroelastomer, or silicone rubber with a fluororesin coating, in order to obtain a proper removability property of toner particles.

Silicone rubber has a low thermal conductivity and therefore, the surface temperature of the fixing roller largely varies with the passing-through of the recording sheets. Temperature variations of the fixing roller result in image degradations such as gloss variations and colour instabilities.

In order to solve the above problems, various countermeasures have been taken: U.S. Pat. No. 5,504,567 discloses a temperature control with feedforward. A Schmitt-predictor is another method for refinement of temperature control as known by those skilled in the art of system control theory.

U.S. Pat. No. 5,493,378 discloses a method to remedy the difference between first and second roller revolutions, leading to visible marks on the image, especially for heavy paper, by using two different fusing speeds.

Most electrophotographic apparatuses have an upper limit in thickness of the receiving media they can handle. A heated fixing roller that has been kept at a standby temperature loses heat as it fuses the toner images, thereby lowering its temperature. Although the temperature control of the fuser immediately begins to compensate for the lowered temperature by increasing the electrical power to its heaters, the immediate temperature drop changes the heat actually applied to the image. The total heat imparted to the toner image controls the amount of gloss of the image. Irrespective of the gloss amount of the image, the gloss evenness across the image is most important.

Preferred gloss levels for xerographic colour images on various paper types are described in: E. N. DALAL and P. C. SWANTON "Electronic Imaging" Vol.5,nr 2 "Preferred gloss levels for colour images". This article describes that a lower image gloss is preferred for the business graphics images than for the pictorial images on a given paper.

U.S. Pat. No. 5,300,995 discloses a heated pressure roller fuser which gradually reduces the speed of the rollers in order to compensate for the temperature drop caused by the loss of heat to the sheet.

OBJECTS OF THE INVENTION

It is a first object of the invention to obtain good fusing quality and pre-defined gloss for single-pass fusing preferably without intermediate fusing.

It is a second object of the invention to obtain good fusing quality and pre-defined gloss for single-pass duplex fusing, preferably without intermediate fusing.

It is a third object of the invention to obtain good fusing quality and pre-defined gloss for single-pass multi-layer fusing, preferably without intermediate fusing.

It is a fourth object of the invention to obtain good fusing quality and pre-defined gloss for single-pass duplex multi-layer fusing, preferably without intermediate fusing.

It is another object of the invention to take into account the printing process parameters which are important for controlling the gloss, like: fusing temperature, fusing speed, toner characteristics, media type and weight and the number of prints to be made.

SUMMARY OF THE INVENTION

A fused toner image is an image, formed by toner particles that are melted by heating so as to adhere to the sheet. A pre-defined gloss is related to a quantity of light reflectance that can be measured with a gloss meter. Knowing that a low fusing temperature gives low gloss and high temperature gives higher gloss, means that selecting a defined fusing temperature corresponds to a defined gloss; other influencing factors will be discussed below. The temperature of the fusing rollers can be measured by sensors. The measurement results of the sensors may control the heaters in the rollers. A contactless temperature sensor can be an infra-red sensor that is able to measure the temperature of a roller without making contact with the roller. A fusing period is a period during which substantial thermal transfer occurs. Multi-layer fusing can be colour fusing but different achromatic toners may also be used: EP-A-95 202 768 describes a method for stable electrostatographic reproduction of a continuous tone image using at least two achromatic toners. Further advantages and embodiments of the present invention will become apparent from the following description and drawings.

DETAILED DESCRIPTION OF THE INVENTION

Figure 1:
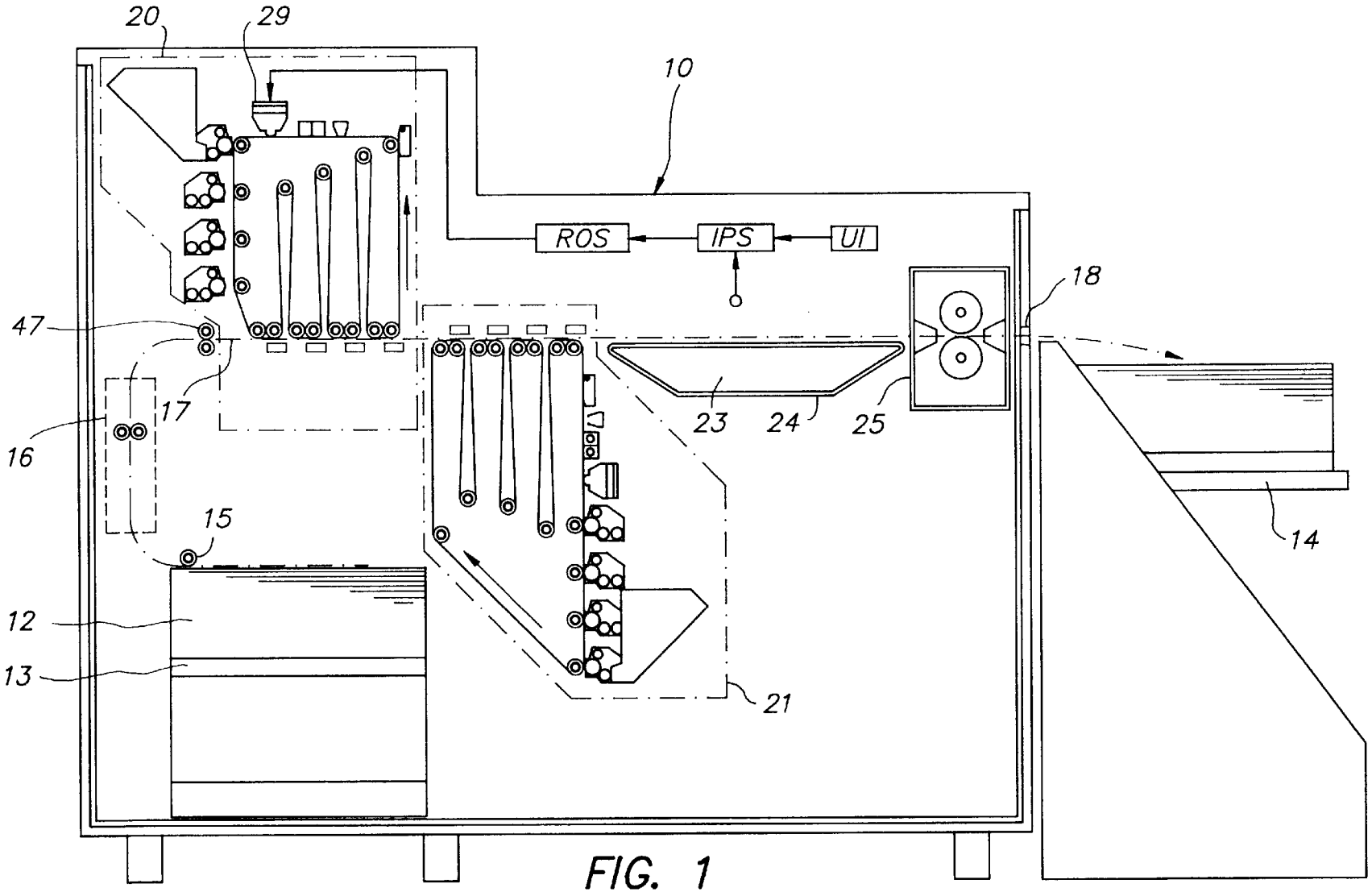
FIG. 1 shows a diagrammatic representation of one embodiment of an electrophotographic duplex colour printer.

FIG. 1 shows a diagrammatic representation of one embodiment of an electrophotographic duplex colour printer.

The printer comprises a lighttight housing 10 which has at its inside a stack 12 of sheets to be printed. The sheets are loaded on a platform 13, the height of which is adjusted in accordance with the size of the stack. The printer has its output at a platform 14 onto which the printed sheets are received.

A sheet to be printed is removed from stack 12 by a dispensing mechanism 15 which may be any mechanism known in the art such as a friction roller, a friction pad, a suction cup, or the like for removing the top sheet from stack 12.

The removed sheet is fed through an alignment station 16 which ensures the longitudinal and lateral alignment of the sheet, prior to its start from said station under the control of the imaging system. As the sheet leaves the alignment station, it follows a straight horizontal path 17 up to outlet 18 of the printer. The speed of the sheet, upon entering said path is determined by driven pressure roller pair 47.

The following processing stations are located along path 17. A first image-forming station 20 is indicated in a dash-and-dot line and is arranged for applying a colour image to the obverse side of the sheet. A second station 21 is arranged for applying a colour image to the reverse side of the sheet. A buffer station 23 with an endless belt 24 is arranged for transporting the sheet to fuser station 25. The buffer station allows the speed of the sheet to change because the speed of fusing at fuser station 25 may be different from the speed of image formation at the image-forming stations 20, 21.

The purpose of buffer 23 is as explained below. Fuser station 25 operates to melt the toner particles transferred to the sheets in order to affix them. This operation requires a certain minimum time since the temperature of the fuser is subject to an upper limit which must not be exceeded, otherwise the roller lifetime becomes unsatisfactory. In other words, the speed of fuser station 25 is limited. The speed of the image formation stations 20 and 21, on the other hand, is basically not limited for any particular reason. On the contrary, it is advantageous to use a high speed of image formation and image transfer, since the four colour separations of each colour image are recorded by exposure station 29 in succession, which means that the recording time of one colour image amounts to at least four times the recording time of one colour separation image. Therefore, a relatively high speed of the photoconductive belts is required, and thus of the synchronously moving sheets, as compared with a maximum usable travelling speed through the fuser station. In the apparatus according to the present embodiment, the speed of the two photoconductive belts amounted to 295 $mm.s^{-1}$, whereas the fusing speed was 100 $mm.s^{-1}$ or less.

Furthermore, it may be desirable to adjust the fusing speed independently of the image processing speed, i.e. the belt speed, for obtaining optimum results. It should be noted that the image processing speed in the imaging stations is preferably constant.

The length of buffer station 23 is sufficient for receiving the largest sheet size to be processed in the apparatus.

Buffer station 23 is operating initially at the speed of the photoconductive belts of devices 20 and 21. The speed of the buffer station 23 is reduced to the processing speed of fuser station 25 as the trailing edge of the sheet has left device 21.

Fusing station 25 can be of known construction, and can be arranged for radiation or flash fusing, for fusing by convection and/or by pressure, etc. According to the present invention hot pressure fusing is preferred. The fused sheet is finally received on platform 14.

A printing apparatus according to the present invention is not limited to the embodiment described hereinbefore.

One image forming station, such as 20, need not necessarily operate with one exposure station, such as 29, but may include more than one exposure station, each such station co-operating with several developer units.

A printing apparatus according to the present invention is not limited to colour reproduction but may also be a black-and-white printer.

A printing apparatus according to the present invention is not limited to duplex printing but may also be a single-side printer.

In an electrographic system, the gloss of a printed image depends on fusing parameters such as fusing time, i.e. contact time between the rollers and hence fusing speed and the contact length, i.e. the length of the nip defined by the pressure roller pair of the fixer; fusing temperature and oil quantity applied to the outer circumference of the rollers.

Figure 2:
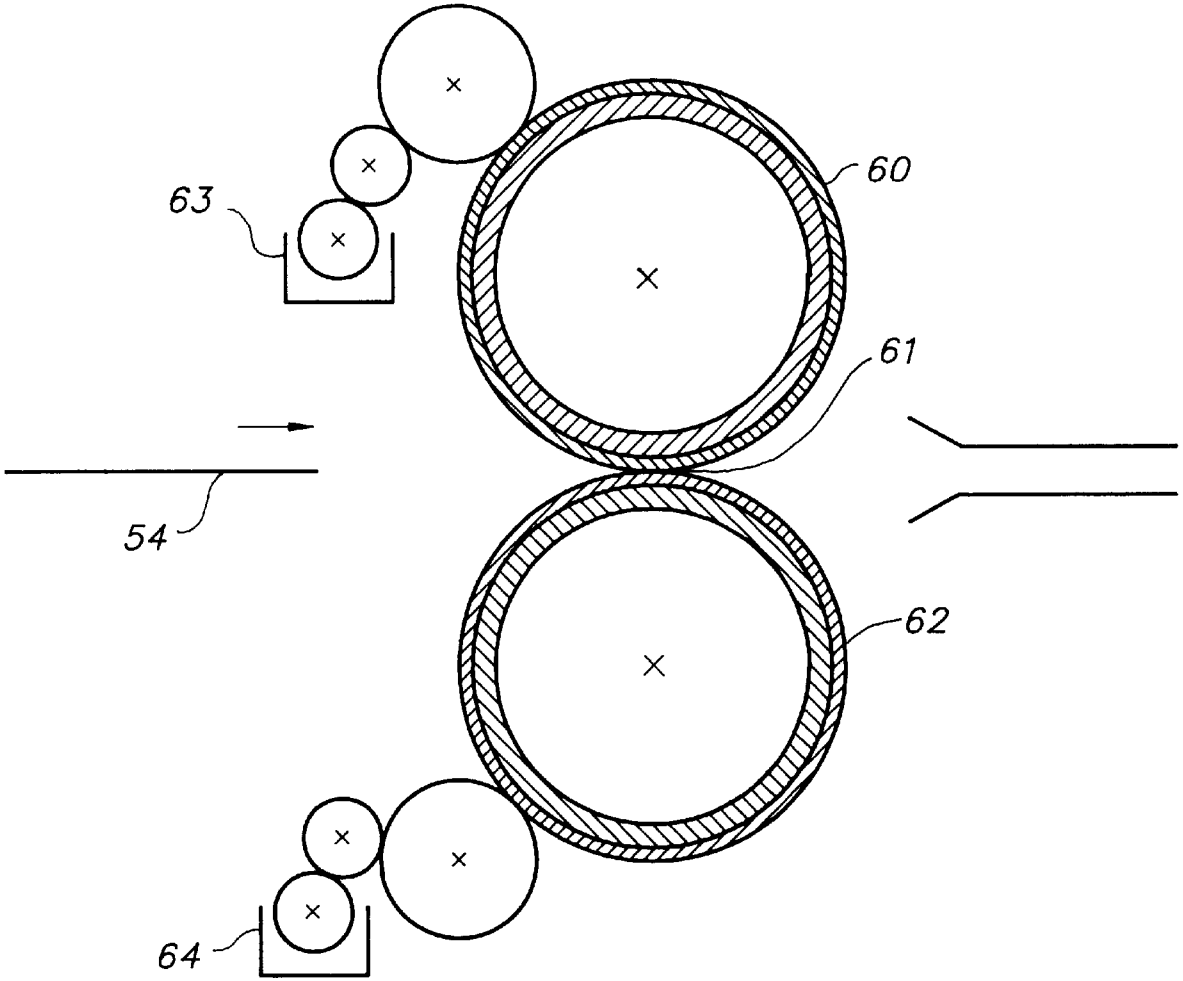
FIG. 2 shows a lateral view of a fuser according to the detailed description of the invention.

By fusing time is meant: the time during which one fuser roller 60, 62 shown in FIG. 2 is in contact with one specific toner particle on the sheet 54. This time depends on the speed of the sheet 54 with relation to the nip 61 formed by the rollers 60, 62 and on the length of the nip 61 formed by the pressure of rollers 60, 62.

The speed of the rollers is proportional to the number of revolutions of the rollers per minute.

The length of the nip 61 or fusing area depends on the pressure of the rollers 60, 62 and the amount of deformation of the fuser rollers per unit pressure. A cam and spring system (not shown) may render the pressure between the two fusing rollers variable in order to vary the nip length. For this application an average pressure between 2 and 4 bar (1 bar=$10^5$ Pa) is required. The average pressure is defined as the ratio (F/A) of the force F between the rollers and the nip contact area A.

A multi-layer toner image, e.g. a colour toner image has characteristics that are substantially different from the characteristics of a black and white toner image. The amount of toner per unit area, referred to as toner mass and expressed in $mg/cm^2$, is typically 2.5 times higher for colour images than for black-and-white images. For colour toner images the 3 or 4 coloured toners are transferred onto the receiving sheet with overlapping areas. The melting point of colour toners is also substantially different compared to black toners. The viscosity of toners is another parameter that influences the gloss.

Also the oil quantity, transferred on the paper surface before the fusing, influences the reflection properties, referred to as gloss. The oil, necessary for its antisticking properties, is responsible for a higher gloss and changes the thermal transfer characteristics of the paper. Oil may be applied to the fuser rollers 60, 61 by oil application units 63, 64 (FIG. 2).

The fusing temperature depends on the thermal capacity and the thermal conductivity of the rollers 60, 61 and the thermal transfer properties from the roller surface to the receiving sheet.

A fusing temperature range can be 130° C.–220° C.

A known method for improving the response of a temperature change is a feedforward method. This method takes into account how many images are ordered by the user.

If only the fusing temperature is controlled, it is very difficult to obtain a homogeneous or a pre-defined gloss.

An alternative for changing the gloss of an image consists in changing the speed of the fixing rollers. Each of the two parameters, the temperature and the speed, may be controlled in such a manner that the heat transferred to the toner is adapted to the melting point of the toner.

Several experiments have now proven that preferentially a combination of fusing time and fusing temperature can give satisfactory results.

A change of fusing time gives a fast response, whereas a temperature change can hardly trigger an immediate reaction of the fusing process, because of the thermal capacity of the fusing rollers.

A user of a copier or a printer may want to choose between different options before he will give the print command. One of the options is the gloss grade. The gloss of a specific medium can be chosen within certain limits.

Fusing at a high speed and at the lowest fusing temperature results in a lower gloss. On the other hand, fusing at low speed and at the highest temperature will result in the highest possible gloss for that specific medium.

Once the desired gloss is given, a microprocessor can choose among a wide range of fusing temperatures and combine them with a wide range of fusing speeds for a given paper type and toner type. These combinations for a specific gloss level can be stored in different types of electronic memory buffers like: RAM, ROM, PROM, EPROM, hard disc or other non-volatile memories.

In one embodiment that microprocessor needs to take into account: the paper thickness, the toner type, the paper weight, the humidity and rigidity of the paper.

The temperature of the fusing process may be influenced to a large extent by the temperature of the medium, the temperature of the fusing oil, the temperature of the toner, the ambient temperature conditions and parameters like the humidity and the thickness of the medium. Measuring the temperature of all the above components is a rather complicated matter.

Figure 3:
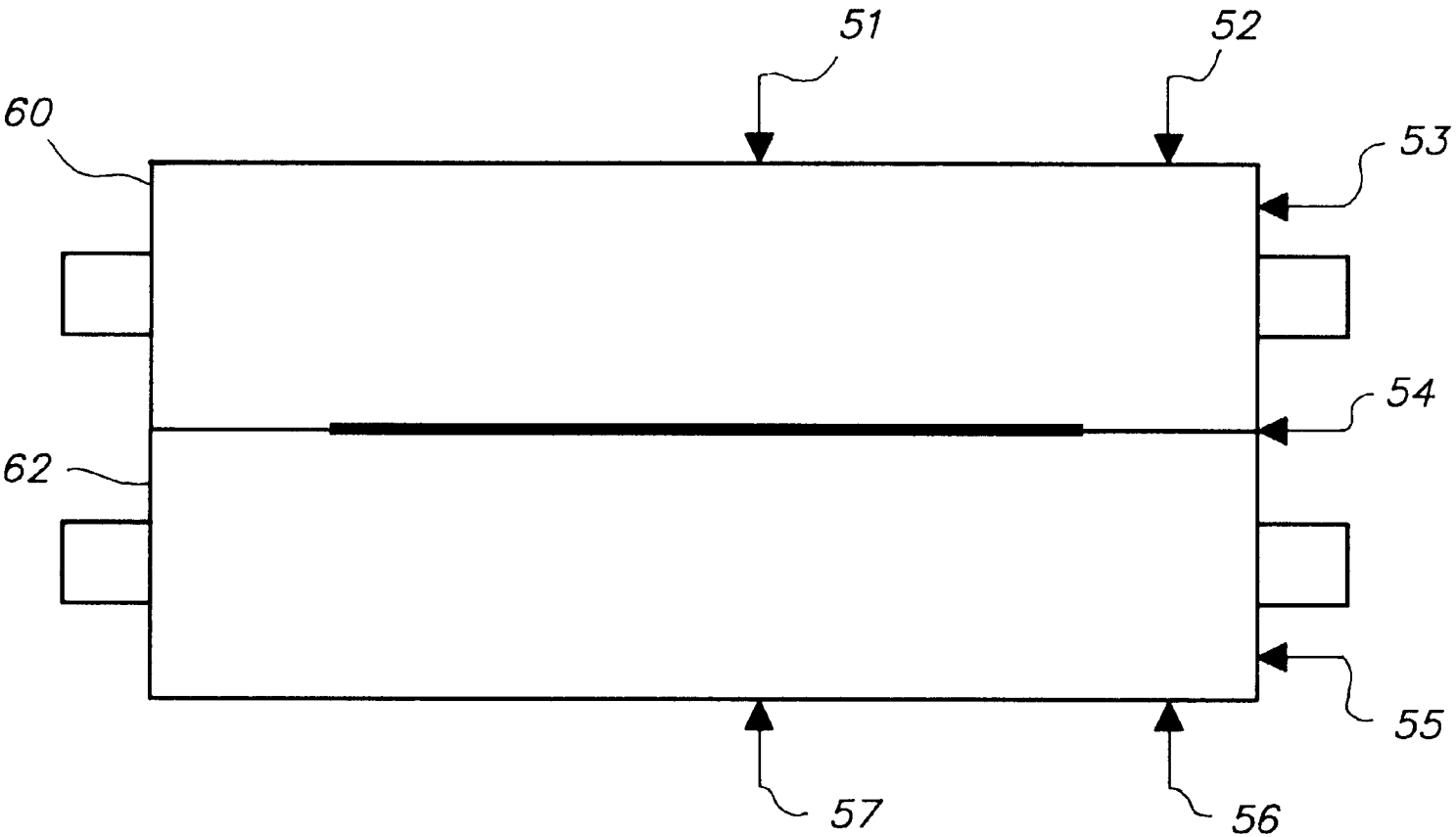
FIG. 3 shows a rear view of the same fuser as FIG. 2.

Instead of keeping track of all the above mentioned parameters, the fusing temperature may be measured on three locations at the first fusing roller 60, and on three locations at the second fusing roller 62 (FIG. 3).

A first location 51 is situated on the in-image area of the surface of the roller 60; a second location 52 on the out-image area of the surface of the roller 60; a third location 53 is situated on the metal core of the fusing roller 60. The latter temperature measurement on the third location 53 will prevent overheating of the roller 60, which could result in damaging the rubber on the roller.

The measurement of the temperature at point 51 may be realised by the use of a NTC sensor which makes contact with the roller.

The measurement of the temperature at point 51 may be preferentially realised by the use of a contactless infra-red temperature sensor avoiding damage to the roller which results in artifacts on the end product.

The measurement of the temperature at point 52 is advantageous for controlling and calibrating sensor 51 when the system is in the stand-by position. In that position the temperature at point 51 will become the same as at point 52 because there is no heat-loss due to the fusing of sheets. When several sheets need to be fused, sensor 52 together with sensor 53 may be used to limit the temperature.

The temperature of fusing roller 62 may be controlled at the points 55, 56 and 57, which have the same function as points 53, 52 and 51 respectively.

When the temperature of the two fusing rollers is measured by the two sensors 52 and 56, it may be,because of cost reasons, advantageous to dispense with sensor 57. The temperature difference between rollers 60 and 62, e.g. because roller 60 is located above roller 62, is $T_{52}-T_{56}$, measured in standby circumstances. To a good approximation, $T_{57}-T_{51}-(T_{52}-T_{56})$.

The temperature of the fuser rollers as a continuously changing parameter, in combination with the medium specifications, colour or black and white, simplex or duplex and the selected gloss grade, are input conditions for a microprocessor that can be controlled by neural networks.

At present, each sensor has to be controlled and monitored separately. Neural networks can be trained to take over the work and to process the data received from the sensors that control the production process. A computer can use the lessons it learnt processing similar data in training to come up with the right solutions.

Conventional control or fuzzy logic control can be used to obtain the most efficient result by combining fusing temperature with fusing speed at any time, taking into account: the chosen gloss grade, the paper quality and the number of prints to be made.

A homogeneous gloss can so be realized by adapting the speed of the fusing rollers page by page when the fusing temperature has dropped as a result of extreme heat loss. The fusing speed can fluctuate between 25 $mm.s^{-1}$ and 295 $mm.s^{-1}$ whereas the speed of the photoconductive belts amounts to 295 $mm.s^{-1}$.

Figure 4:
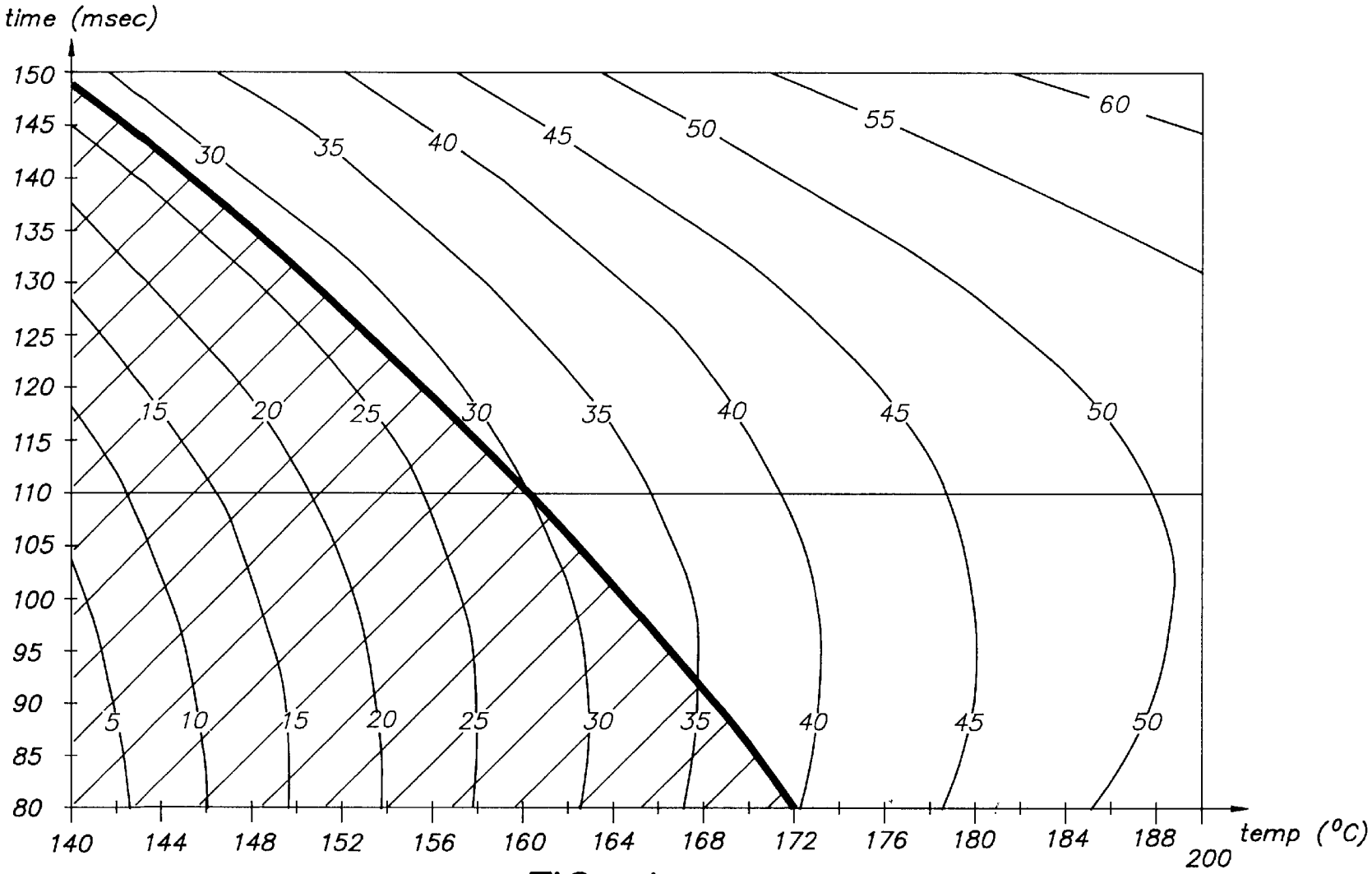
FIG. 4 shows the relation between the fusing temperature and the fusing period for a specific case and different gloss grades marked by the curved lines.
Figure 5:
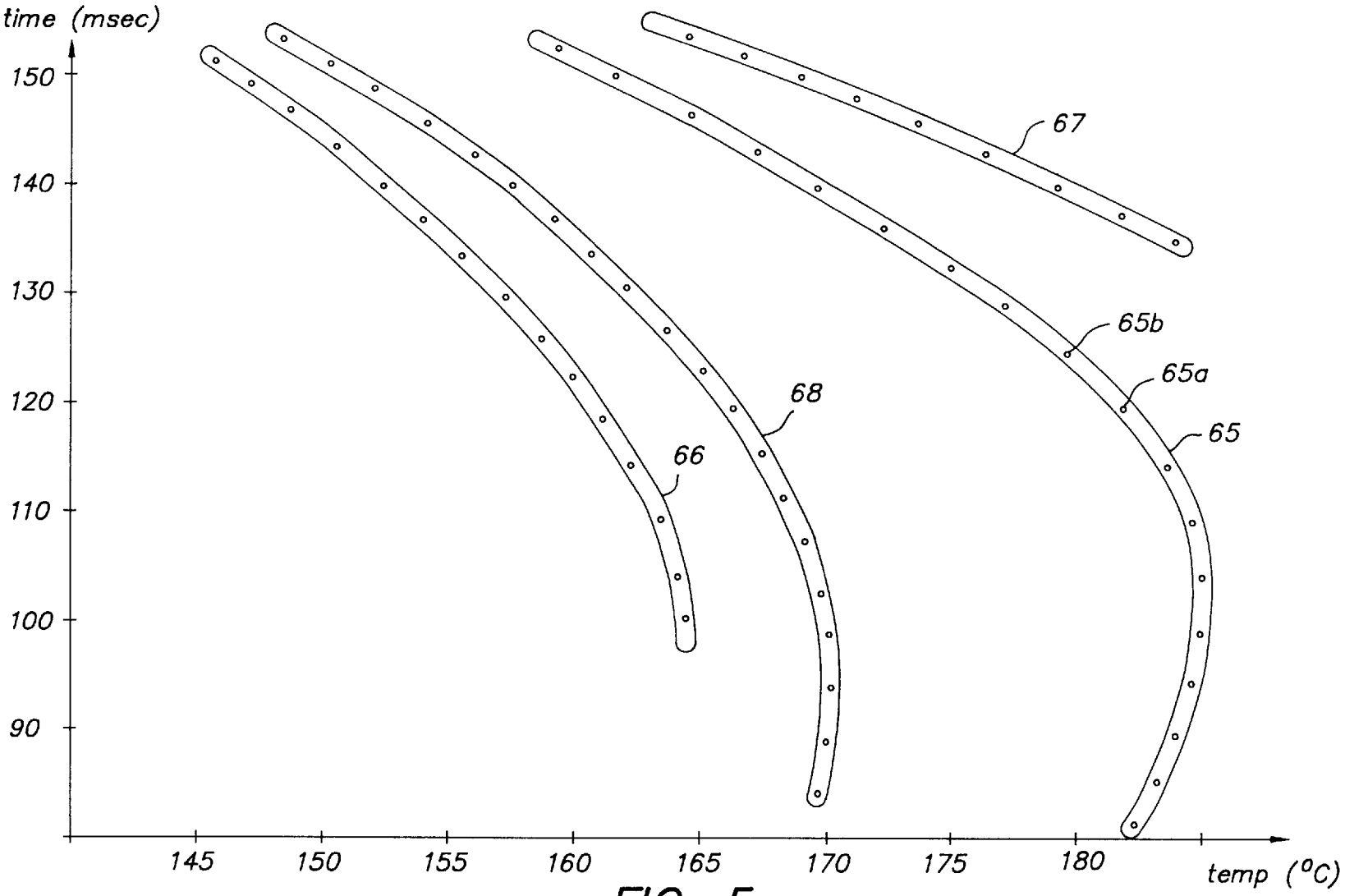
FIG. 5 shows the fusing speed and temperature ranges divided in gloss grade areas (35% and 50%) for two specific media.

FIG. 4 gives an illustration of the invention. The graph illustrates a relation between the fusing temperature (temp) in ° C. and the fusing period (t) in msec. The gloss is measured by a Minolta Multi-Gloss 268 meter, set at the 60° geometry. The gloss on the graph is indicated by the numbers 5 till 60 on the curved lines. The toner quantity is 1 $mg/cm^2$ and the toner dimensions are 7–8 $\mu$m. The viscosity of the toner is 358 Pa.s, measured with a rotationviscosity meter at 120° C. and 100 rad/sec. The paper type is Agfa 1001 Neusiedler (100 g). The fusing oil quantity is 10 mg/A4. The upper fusing roller, making contact with the sheet, has a diameter of 49 mm while the lower fusing roller has a diameter of 50 mm. The rubber on the rollers has a thickness of 3 mm and a hardness of 40 Shore A. The rubber consists of three layers: a core of filled silicone rubber, a transition layer and an outer layer of pure, unfilled silicone rubber. The shaded area on FIG. 4 contains combinations of fusing temperature and fusing period that result in unacceptable fusing quality. This can be translated in insufficient adherence of the toner to the paper. The other area gives an idea of the gloss range (30–60) for the above mentioned materials and situations. FIG. 5 is basically the same as FIG. 4. A user can select a paper quality Agfa 701 Neusiedler (80 g) and a pre-defined gloss 55. The microprocessor calculates a fusing temperature to start and a corresponding fusing period according to the graph (65*a*). After a number of copies when the fusing temperature has dropped as a result of extreme heat-loss and when the heaters in the fusing rollers have not been able to keep the temperature on the same value, a lower fusing period can be chosen by the microprocessor (65*b*). The working range for the fuser to get a gloss grade of 55 with paper 701 is illustrated by area 65. Area 66 gives the working range for the fuser to get a gloss grade of 40 with paper 701. So a lower gloss grade can be reached by a lower fusing temperature and/or a higher fusing speed. Areas 67 and 68 of FIG. 5 give an illustration of the working range for the fuser to get the 2 different gloss grades with paper 1001, which has a higher weight than paper 701 and therefor needs a higher fusing temperature at lower fusing speeds to get the same gloss (40 and 55). Preferentially there are no speed changes possible during the fusing of a sheet, because this could result in gloss differences within one sheet.

The invention is not limited to sheet-fusing. When web-fusing is applied, a variable speed controller is necessary or a buffer with a slack is needed in order to compensate for the speed variations of the fuser rollers.

What is claimed is:

1. A method for fusing a toner image to a sheet to achieve a homogeneous and pre-defined gloss comprising the following steps:

establishing a gloss value for said pre-defined gloss;

selecting a fusing temperature in accordance with said gloss value;

selecting a fusing period in accordance with said gloss value;

controlling the fusing temperature of at least one fuser roller within a narrow range encompassing said selected temperature; and, fusing said toner image to said sheet by pressing toner and said sheet in rolling contact with said fuser roller.

2. The method according to claim 1, including the step of selecting a rotation speed for said at least one fuser roller based on said gloss value.

3. The method according to claim 2, wherein a buffer is operating at a speed corresponding to the rotation speed of said at least one fuser roller.

4. The method according to claim 2, wherein the rotation speed for said at least one fuser roller remains substantially constant over a length of the sheet.

5. The method according to claim 1, comprising an additional step of measuring an instant surface temperature of said at least one fuser roller by at least one contactless sensor directed towards a surface area of said at least one fuser roller.

6. The method according to claim 5, including an additional step of selecting a fusing period in accordance with said instant surface temperature and said gloss value.

7. The method according to claim 5, including an additional step of selecting a fusing period using a neural network to optimally combine said instant surface temperature, said fusing temperature, and said gloss value.

8. The method according to claim 5, including an additional step of selecting a fusing temperature using a neural network to optimally combine said instant surface temperature, said fusing period, and said gloss value.

9. The method according to claim 1, comprising an additional step of selecting said gloss value within a range of gloss values.

10. The method according to claim 9, wherein said range of gloss values is set according to a minimum melting point of said toner and a maximum temperature for said fuser rollers.

11. The method according to claim 1, comprising the steps of:

selecting a paper type;

selecting a toner type;

establishing a relation in which the gloss value is a function of fusing period and temperature, for said selected paper type and said selected toner type;

establishing a value for said gloss level;

selecting said fusing period and said temperature based on said relation and on said gloss level.

12. The method according to claim 11, comprising the step of controlling said fusing by a computer using a neural network whereby the fusing temperature and the fusing speed are optimally combined.

13. A method according to claim 1, wherein said fusing period is selected in accordance with said gloss value and with said fusing temperature.

14. The method according to claim 13, including an additional step of selecting a rotation speed for said at least one fuser roller in accordance with said gloss value and with said fusing temperature.

15. The method according to claim 1, including an additional step of selecting a fusing period using a neural network whereby said fusing temperature and said gloss value are optimally combined.

16. An apparatus for fusing a toner image to a sheet to achieve a homogeneous and pre-defined gloss comprising:

means for establishing a gloss value for said pre-defined gloss;

means for selecting a fusing temperature in accordance with said gloss value;

means for controlling the fusing temperature of at least one fuser roller within a narrow range encompassing said selected temperature;

means for fusing said toner image to said sheet by pressing toner and said sheet in rolling contact with said fuser roller; and means for selecting a fusing period for said means for fusing in accordance with said gloss value.

17. An apparatus according to claim 16, wherein said means for selecting a fusing period for said means for fusing selects the fusing period in accordance with said gloss value and with said fusing temperature.

18. An apparatus according to claim 16, wherein said means for selecting a fusing period includes a neural network to optimally combine said gloss value and said selected temperature.

19. An apparatus according to claim 16, further comprising at least one means for measuring an instant surface temperature of said at least one fuser roller.

20. An apparatus according to claim 19, wherein the means for measuring an instant surface temperature is a contactless sensor.

21. An apparatus according to claim 19, wherein said means for selecting a fusing period for said means for fusing selects the fusing period in accordance with said gloss value and with said instant surface temperature.

22. An apparatus according to claim 19, wherein said means for selecting a fusing period includes a neural network to optimally combine said instant surface temperature, said fusing temperature and said gloss value.

23. An apparatus for fusing a toner image to a sheet to achieve a homogeneous and pre-defined gloss comprising:

a gloss meter;

a gloss value established by the gloss meter for said predefined gloss;

a microprocessor for selecting a fusing temperature in accordance with said gloss value, and for selecting a fusing period for said means for fusing in accordance with said gloss value;

a temperature controller for controlling the fusing temperature of at least one fuser roller within a narrow range encompassing said selected temperature;

a fuser for fusing said toner image to said sheet by pressing toner and said sheet in rolling contact with said fuser roller.

24. An apparatus according to claim 23, wherein said microprocessor selects the fusing period in accordance with said gloss value and with said fusing temperature.

25. An apparatus according to claim 23, wherein said microprocessor includes a neural network.

26. An apparatus according to claim 23, further comprising at least one temperature sensor for measuring an instant surface temperature of said at least one fuser roller.

27. An apparatus according to claim 26, wherein the temperature sensor is a contactless sensor.

28. An apparatus according to claim 26, wherein said microprocessor selects the fusing period in accordance with said gloss value and with said instant surface temperature.

29. An apparatus according to claim 26, wherein said microprocessor includes a neural network to optimally combine said instant surface temperature, said fusing temperature and said gloss value.

30. An apparatus according to claim 23, wherein said temperature controller includes a neural network.

* * * * *